United States Patent [19]

Burge

[11] 4,000,620

[45] Jan. 4, 1977

[54] GRAVITATIONAL IRRIGATION SYSTEM AND METHOD OF INSTALLING

[76] Inventor: Merle M. Burge, Box 1123, Kittitas, Wash. 98934

[22] Filed: Nov. 6, 1974

[21] Appl. No.: 521,294

[52] U.S. Cl. ..... 61/12; 61/105; 251/145; 285/200

[51] Int. Cl.[2] ..... E02B 13/00

[58] Field of Search ..... 61/12, 13, 11, 10, 72.1, 61/72.6; 251/145; 285/200, 208, DIG. 2, DIG. 22; 220/352; 150/35

[56] References Cited

UNITED STATES PATENTS

| | | | |
|---|---|---|---|
| 1,143,351 | 6/1915 | Benson | 61/12 |
| 2,387,539 | 10/1945 | Spanel | 285/200 |
| 2,763,991 | 9/1956 | Kennon | 61/72.6 X |
| 2,777,490 | 1/1957 | Munk | 61/12 X |
| 3,128,900 | 4/1964 | Chaboche | 220/270 |
| 3,490,791 | 1/1970 | Mitchel | 285/208 X |
| 3,814,377 | 6/1974 | Todd | 61/13 X |

OTHER PUBLICATIONS

Popular Mechanics, Feb. 1957, p. 287, 61–12.

*Primary Examiner*—Jacob Shapiro
*Attorney, Agent, or Firm*—Seed, Berry, Vernon & Baynham

[57] ABSTRACT

A gravitational irrigation system is disclosed which uses preformed, water-impervious, flexible, collapsible, plastic tubing as a replacement for an open ditch. The tubing is laid in a shallow trench along the area to be irrigated and held in place by mounds of soil thrown on the top thereof. Annular apertures are cut in the tubing at intervals where exit of water is desired. Flexible, annular, open-ended spigots having a flanged end of greater diameter than the diameter of the body of the spigot are inserted, flange end first, into the apertures to form a laterally extending spigot from the tubing. The body of the spigot has an outer diameter approximating the diameter of the cut in the tubing. The flange of the spigot substantially seals against water leakage between the tubing and the flange of the spigot. Each spigot includes a raised annular ridge extending around the outer circumference of the body thereof which mates with a corresponding raised annular ridge extending around the internal circumference of a matching closed-end cap, the cap sealing the opening in the spigots.

5 Claims, 5 Drawing Figures

FIG. 1
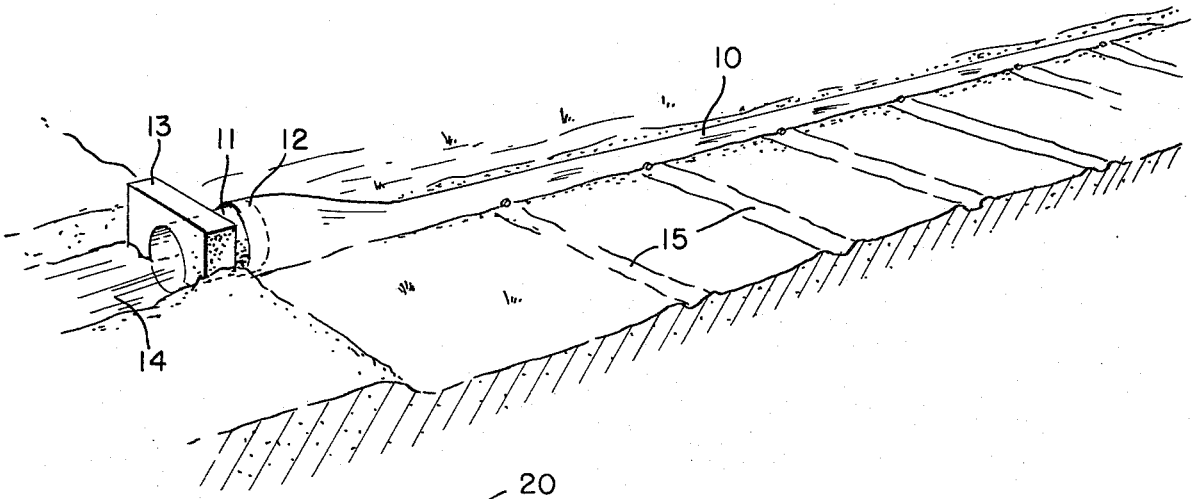
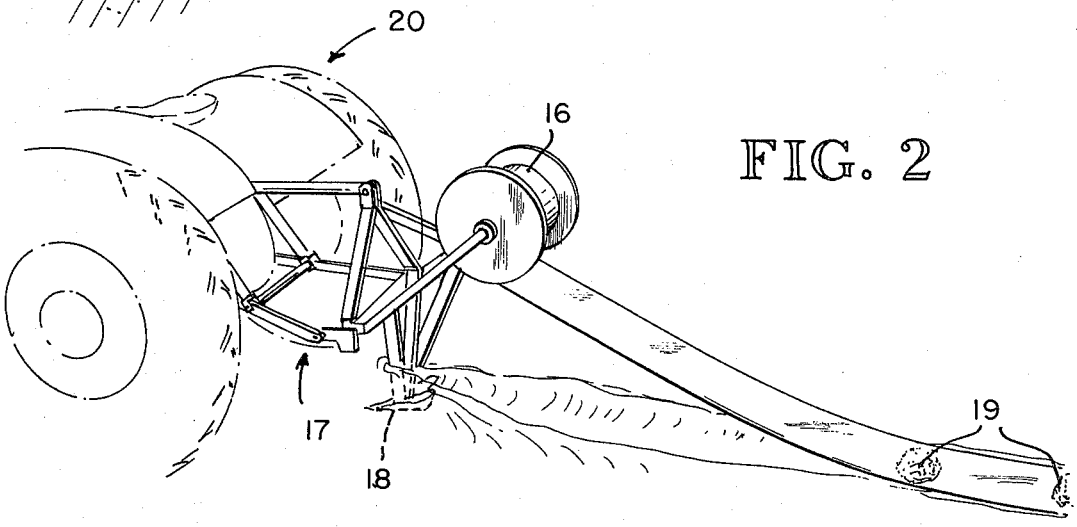
FIG. 2
FIG. 3
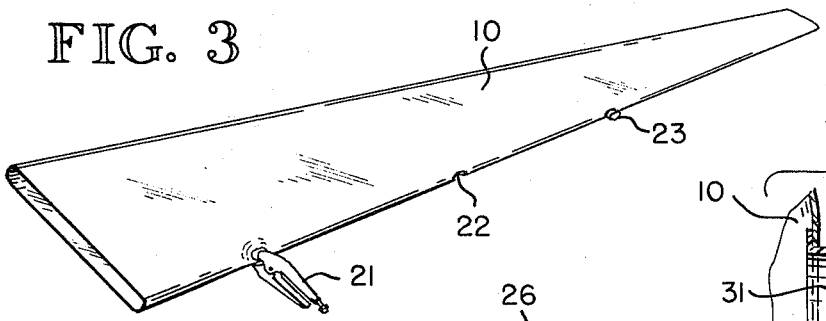
FIG. 5
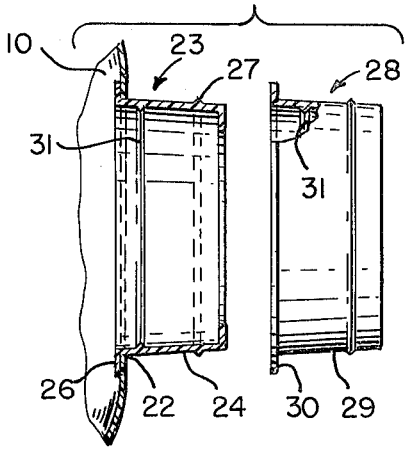
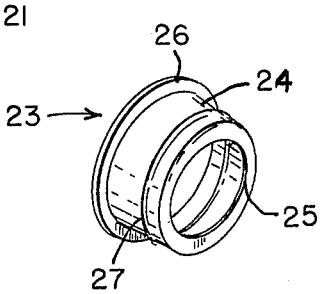
FIG. 4

GRAVITATIONAL IRRIGATION SYSTEM AND METHOD OF INSTALLING

BACKGROUND OF THE INVENTION

1. Field of the Invention

This invention relates to a gravity flow irrigation system employing flexible plastic tubing and to a method of installing the same.

2. Prior Art Relating to the Disclosure

Irrigation systems utilizing flexible conduit are known. For example, see U.S. Pat. Nos. 1,143,351; 2,595,408 and Reissue No. 14,081.

SUMMARY OF THE INVENTION

Preformed, water-impervious, collapsible, plastic tubing is laid in a shallow trench adjacent the area to be irrigated. Spades of soil are thrown at spaced intervals over the tubing to hold it in place in the trench. One end of the tubing is connected to a source of water and the other end is restricted to control exit of water. Annular apertures are cut in the tubing at intervals along the tubing where exit of water is desired and flexible, open-ended, annular spigots extended through the apertures, allowing water to exit from the tubing. The outer circumference of the spigot has a raised annular ridge thereon which mates with a corresponding raised ridge extending around the internal surface of a matching, closed-end cap for the spigot to seal the spigot against exit of water.

BRIEF DESCRIPTION OF THE DRAWINGS

FIG. 1 is an overall perspective view of the gravity irrigation system of this invention;

FIG. 2 is a perspective view of the initial step of installing the system in a field to be irrigated;

FIG. 3 illustrates the steps after extension of the preformed tubing adjacent the area to be irrigated, the steps including cutting an aperture where desired in the tubing and inserting a spigot with or without a cap in each of the cut apertures; and FIG. 4 is a perspective view of the cap and spigot.

FIG. 5 is a side elevational view of the cap and spigot.

DESCRIPTION OF THE PREFERRED EMBODIMENTS

Referring to FIG. 1, preformed, flexible, collapsible plastic tubing 10 is extended adjacent the area to be irrigated and is connected at one end to a section of corrugated, reinforced, flexible pipe 11 and secured therto by suitable means, such as a metal strap, elastic band, etc. 12. The reinforced pipe 11 is connected at its free end to a planar member 13 placed across an open ditch 14 through which irrigation water flows. The water flowing throught the tubing 10 exits therefrom at spaced intervals through spigots, to be described. The exiting water flows down rows 15 of the area to be irrigated.

The preformed plastic tubing used may be any of a variety of materials but is preferably commercially available polyethylene tubing. The tubing is available in rolls having a length of 1,400 feet or more. The roll 16 of plastic tubing is suspended from an attachment 17 connected to the rear of a tractor 20. The attachment includes a plough which excavates a V-shaped trench 3 to 4 inches deep as the tractor moves along. As the tractor is pulled across the area where the plastic tubing is to be laid, the V-trench is formed by the plough portion 18 and the preformed plastic tubing laid in the trench and covered at spaced intervals by hand with mounds of dirt 19, thereby preventing the lightweight plastic tubing from being blown out of the shallow trench by the wind or pulled out inadvertently by other means. After the flexible tubing is laid, one end of the tubing is secured to the section of reinforced pipe 11, as illustrated in FIG. 1, and the reinforced pipe connected to a source of water. The opposite end of the plastic tubing is restricted to control exit of water therefrom.

Referring to FIG. 3, a cutting device 21 is used to cut annular apertures 22 in the plastic tubing 10 at desired intervals where exit of water is needed. The apertures may be cut to any size desired, depending on the amount of water needed. Annular, open-ended spigots 23 are inserted into each of the apertures for exit of water therethrough. Each spigot 23 includes an annular, open-ended body portion 24 having an inwardly directed flange portion 25 at one end and an outwardly extending flange portion 26 at the other end of greater diameter than the body. A ridge 27 extends around the circumference of the body portion at about the midpoint between flange 25 and flange 26. The outer diameter of the body portion 24 approximates the diameter of the apertures cut in the plastic tubing so that when the spigot is inserted in place, it fits snugly therein. When water is run through the tubing, the pressure of water bearing against the flange 26 prevents any significant leakage of water from the tubing around the spigot out through the intersection between the spigot and the walls of the plastic tubing.

It may be necessary at times to cap some of the water spigots with a cap 28. The cap 28 includes an annular body portion 29 terminating in a flange 30 of greater diameter than the annular body portion at one end and closed at the other end. A ridge 31 extends around the inner circumference of the body portion of the cap, this ridge mating with the ridge extending around the spigot to form a mechanical and frictional lock when the cap is placed over the spigot to prevent exit of water therethrough until desired. The cap may be removed and replaced as desired. The system disclosed is sufficiently flexible to follow the contours of a field without special fittings.

The system was designed for fast and easy installation and requires a minimum of time once in operation. The system is capable of delivering and distributing an even, continuous flow of water without need for checking and making adjustments every few hours. The cost of the system is sufficiently reasonable that if embrittled by constant exposure to weather conditions and sunlight, at the end of a growing season it may be thrown away and additional tubing purchased for the next growing season.

The embodiments of the invention in which a particular property or privilege is claimed are defined as follows:

1. A gravity-flow irrigation system for irrigating a field of arbitrarily spaced furrows, comprising:

water-impervious, flexible, preformed tubing extending along the ground at arbitrary angles with respect to said furrows adjacent the area to be irrigated, one end of the tubing being secured to a source of water and the other end being restricted to control exit of water, a plurality of longitudinally spaced apertures cut in the tubing after the tubing has been laid along the ground, each of said aperatures being positioned adjacent one of said furrows, and open-ended, annular, laterally disposed outlet spigots in each of the cut apertures.

2. A method of irrigating a field containing a plurality of arbitrarily spaced furrows using a water-impervious, flexible, preformed tubing, comprising:

digging a shallow trench adjacent the area where the flexible tubing is to be extended for irrigation, said trench intersecting a plurality of said furrows at arbitrary angles, laying the tubing in the shallow trench, retaining the tubing in the trench, cutting annular openings in the tubing at longitudinally spaced intervals corresponding to the distance between said furrows so that water exits from the tubing adjacent said furrows, inserting an open-ended outlet spigot in each of the apertures, providing a head of water, connecting one end of the tubing to said water, and restricting the opposite end of the tubing to control exit of water.

3. The method of claim 2, further including the step of adjusting the distribution of irrigation water by selectively placing caps over the spigots as desired to prevent exit of water therefrom.

4. The method of claim 2, further including the step of adjusting the distribution of irrigation water by selectively removing said spigots from said openings and replacing said removed spigots with spigots having openings of differing area.

5. The method of claim 2 wherein said spigot is tapered and its larger end forms an outwardly extending flange, and wherein said step of inserting an open-ended spigot consists of forcing said larger end through the opening and withdrawing the spigot until the flange contacts the inside surface of the tubing encircling the opening whereby the spigot is held in place by the pressure of the water bearing against the flange.

* * * * *